US006097162A

United States Patent [19]

Welch, Jr. et al.

[11] Patent Number: 6,097,162

[45] Date of Patent: Aug. 1, 2000

[54] POWER SUPPLY SYSTEM FOR A FLUORESCENT LAMP

[75] Inventors: Ronald F. Welch, Jr., Oak Ridge; William R. Tombs, Clark; Muthu Murugan, Howell; Robert Saccomanno, Montville, all of N.J.

[73] Assignee: AlliedSignal Inc., Morristown, N.J.

[21] Appl. No.: 09/135,185

[22] Filed: Aug. 17, 1998

[51] Int. Cl.[7] ..... H05B 37/00

[52] U.S. Cl. ..... 315/307; 315/224; 315/209 R; 315/DIG. 4

[58] Field of Search ..... 315/307, 291, 315/209 R, 244, DIG. 4, DIG. 7, 219, 276, 224

[56] References Cited

U.S. PATENT DOCUMENTS 4,438,374 3/1984 Karius ..... 315/362
4,709,188 11/1987 Roberts ..... 315/307
4,914,356 4/1990 Cockram ..... 315/291
4,937,501 6/1990 Ganser et al. ..... 315/291
5,349,268 9/1994 Nagai et al. ..... 315/DIG. 7
5,583,402 12/1996 Moisin et al. ..... 315/307
5,804,924 9/1998 Ohnishi et al. ..... 315/160
5,825,136 10/1998 Rudolph ..... 315/307

*Primary Examiner*—David Vu
*Assistant Examiner*—Wilson Lee
*Attorney, Agent, or Firm*—Loria B. Yeadon

[57] ABSTRACT

A broad range of brightness in a fluorescent lamp may be achieved by applying low-frequency, pulse-width modulated voltage or current to the lamp for a low level of brightness, or high-frequency voltage or current for a high level of brightness. Switching is provided to select between the two signals.

16 Claims, 7 Drawing Sheets

POWER SUPPLY SYSTEM FOR A FLUORESCENT LAMP

BACKGROUND OF THE INVENTION

A means of varying fluorescent light intensity is required in certain applications, such as in avionics, especially at low ambient light levels. Currently, high-frequency switching supplies are used, although at low brightness levels such supplies suffer from non-uniform brightness across the display and flickering caused by arc instability. Superior results have been achieved by utilizing separate supplies for high and low brightness ranges, and switching between them to obtain the desired level of brightness.

DESCRIPTION OF THE INVENTION

Figure 1:
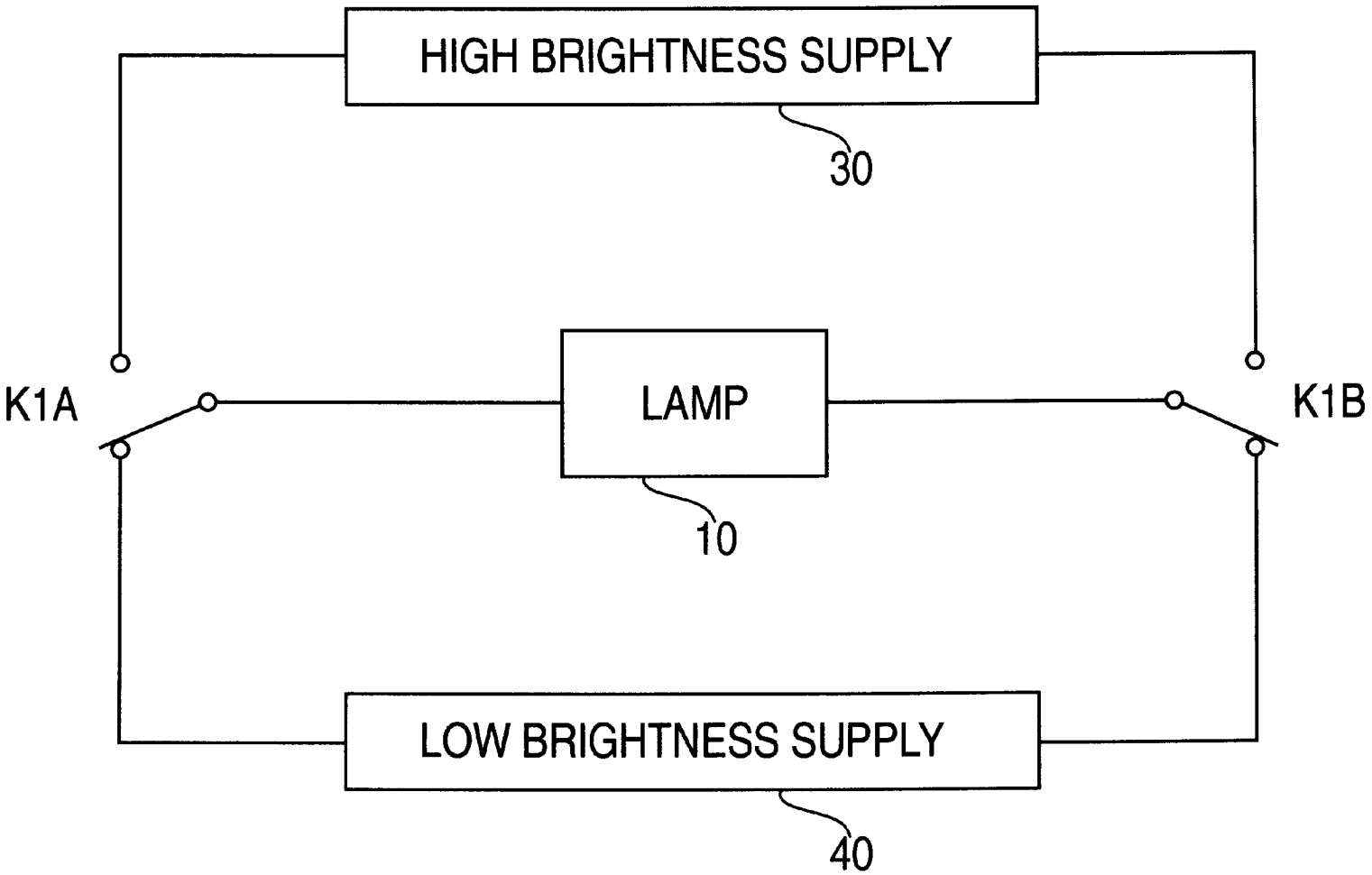
FIG. 1 is a schematic diagram of a power supply for a fluorescent lamp.

A power supply for a fluorescent lamp is shown in the schematic diagram of FIG. 1. A fluorescent lamp 10 is powered by two power supplies: a high brightness supply 30 and a low brightness supply alternately connected through a relay K1. The high brightness supply 30 generates an output voltage that will ignite the gas in the lamp 10 so that it produces its normal level of brightness. If a lower level of brightness is desired, the relay K1 switches, connecting the low brightness supply 40. The voltage level of the low brightness supply 40 is below the ignition voltage and therefore the gas in the lamp 10 will not ignite but rather operates in the glow mode or glow discharge mode. Thus, the lamp 10 is switched back and forth between the two supplies as necessary to achieve the brightness desired.

Figure 2:
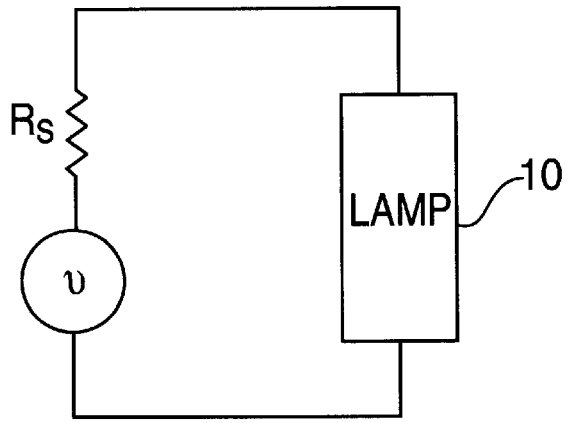
FIG. 2 is a schematic diagram of a voltage-based low brightness supply.
Figure 3:
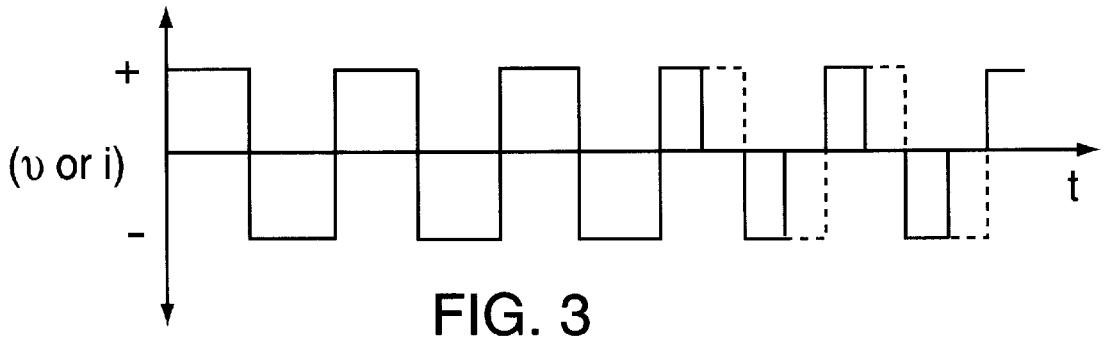
FIG. 3 is a waveform diagram of the output of the voltage source in the circuit of FIG. 2.

A low brightness power supply and a lamp are shown in FIG. 2. There, an ideal voltage source v having a source resistance $R_S$ drives the lamp 10. A suitable waveform for the voltage source output is shown in FIG. 3. Here, the waveform is a bipolar pulse-width modulated square-wave. In the example shown in FIG. 3, the pulses begin at full width per half cycle (i.e., 100% duty cycle), but are only half of that width after the first three cycles, signifying a change in brightness. By varying the pulse width, the RMS voltage applied to the lamp 10 and, therefore, the observed intensity of the lamp 10 similarly varies. Other types of waveforms could be employed (e.g., triangular, sawtooth, sinusoidal). Further, the pulse widths could be varied at the leading or trailing edge.

Figure 4:
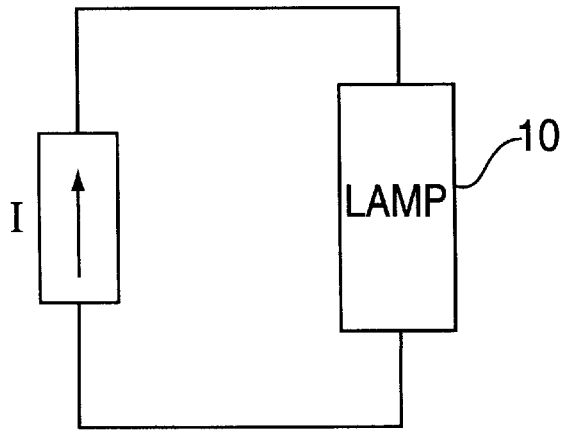
FIG. 4 is a schematic diagram of a current-based low brightness supply.

The constant-current equivalent of FIG. 2 is illustrated in FIG. 4. There, a constant current source I drives the lamp 10.

The same waveform used with FIG. 2 can be employed here, the vertical axis being current i instead of voltage v.

Figure 5:
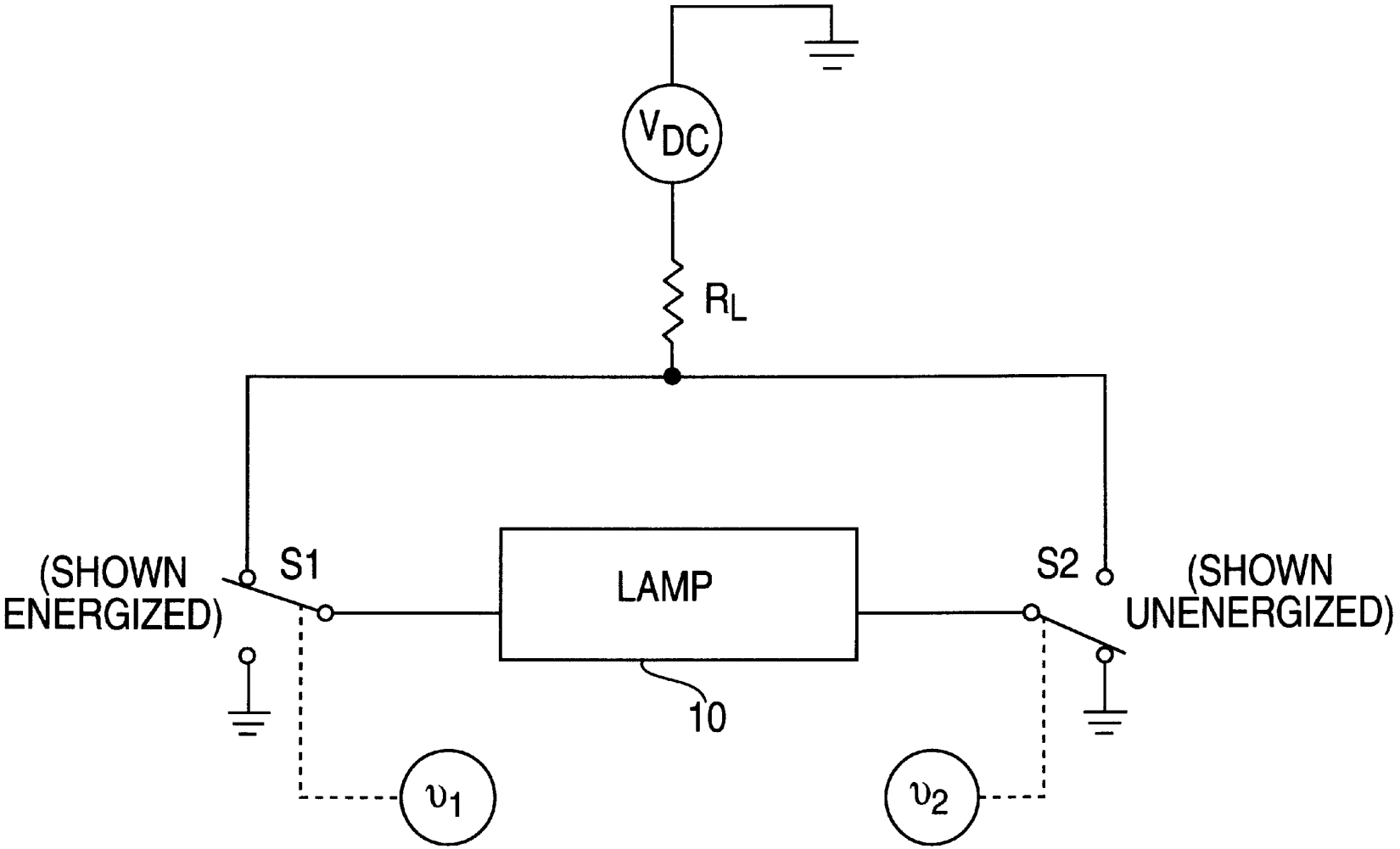
FIG. 5 is a schematic diagram of a configuration of the voltage-based low brightness supply of FIG. 2.

A configuration of the voltage-based low brightness supply of FIG. 2 is shown in FIG. 5. In this circuit, a voltage source $V_{DC}$ is alternately connected to one side or the other of the lamp 10 by switches S1 and S2 controlled by voltage generators $v_1$ and $v_2$, respectively. These generators produce complementary (180° out of phase) pulse-width modulated square wave signals $v_1$ and $v_2$, with duty cycles varying from 0 to 100% (100% being the full half-cycle pulse width) in a frequency range of 60–400 hz. Satisfactory results have been obtained at approximately 100 hz.

Figure 6:
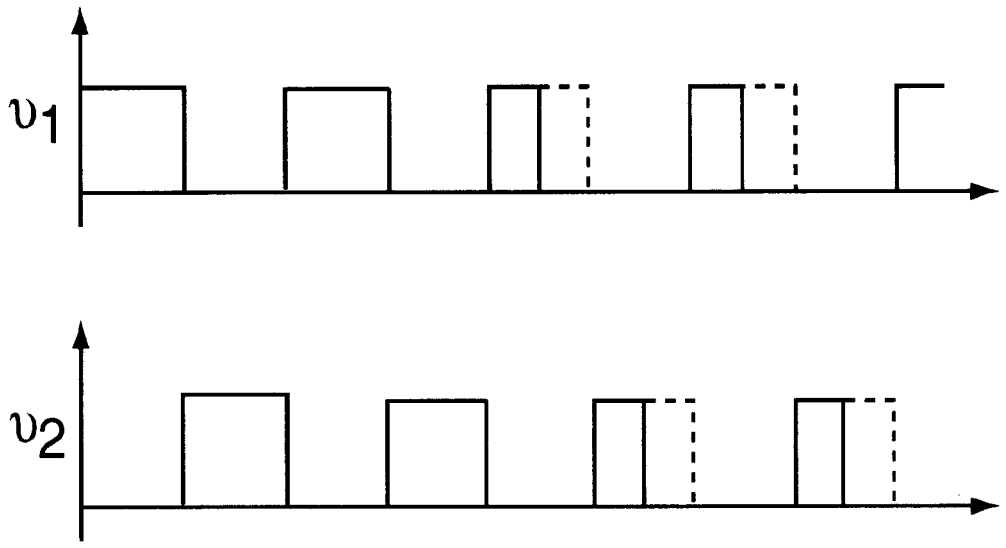
FIG. 6 is a waveform diagram of drive signals for the low brightness supply of FIG. 5.

Typically, the generators are tied to a synchronous clock. Examples of the drive signals are shown in FIG. 6. Of course, other waveforms and frequency ranges could be employed.

Figure 7:
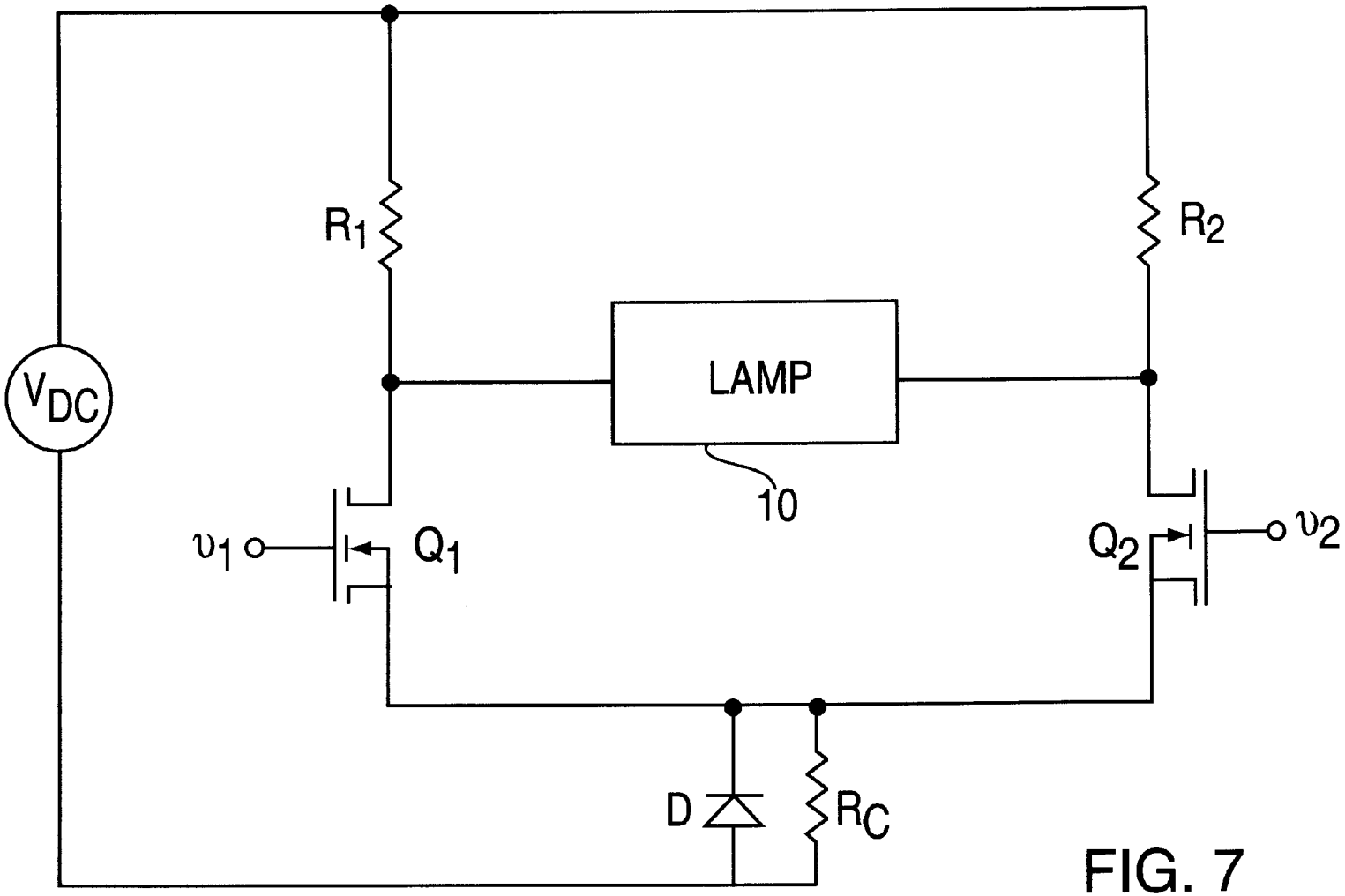
FIG. 7 is a schematic diagram of an implementation of the voltage-based low brightness supply of FIG. 5.

A more specific implementation of the low brightness supply of FIG. 5 is illustrated in FIG. 7. The connections to the high brightness supply are omitted for clarity but it should be understood that such a supply could be used with this circuit.

Each side of the lamp 10 is connected to the junction of a load resistor $R_1$ or $R_2$ and a switching transistor $Q_1$ or $Q_2$. The resistors are chosen to insure that the lamp 10 operates in the glow mode for a given supply voltage. Assuming a supply voltage $V_{DC}$ of 400 volts, a desired lamp voltage of 200 volts, and a lamp resistance of 100K, the load resistors of 100K can be employed. Other voltages and values can be chosen to suit the components and desired design criteria.

When the switching transistors are off, both terminals of the lamp 10 are sitting at the supply voltage $V_{DC}$. The gates of the switching transistors $Q_1$ and $Q_2$ are driven by signals $v_1$ and $v_2$, respectively, the duty cycles of which are varied to achieve the desired brightness level.

The circuit in FIG. 7 uses a voltage divider of a load resistor $R_1$ or $R_2$ and the internal resistance of the lamp 10 to provide a set voltage at the lamp 10 and in turn a predetermined current through the lamp 10. The diode D prevents the source voltage of either $Q_1$ or $Q_2$ from going negative and prematurely turning the other transistor on while the resistor $R_C$ limits the current drawn by the parasitic capacitance of the switching transistors.

Figure 8:
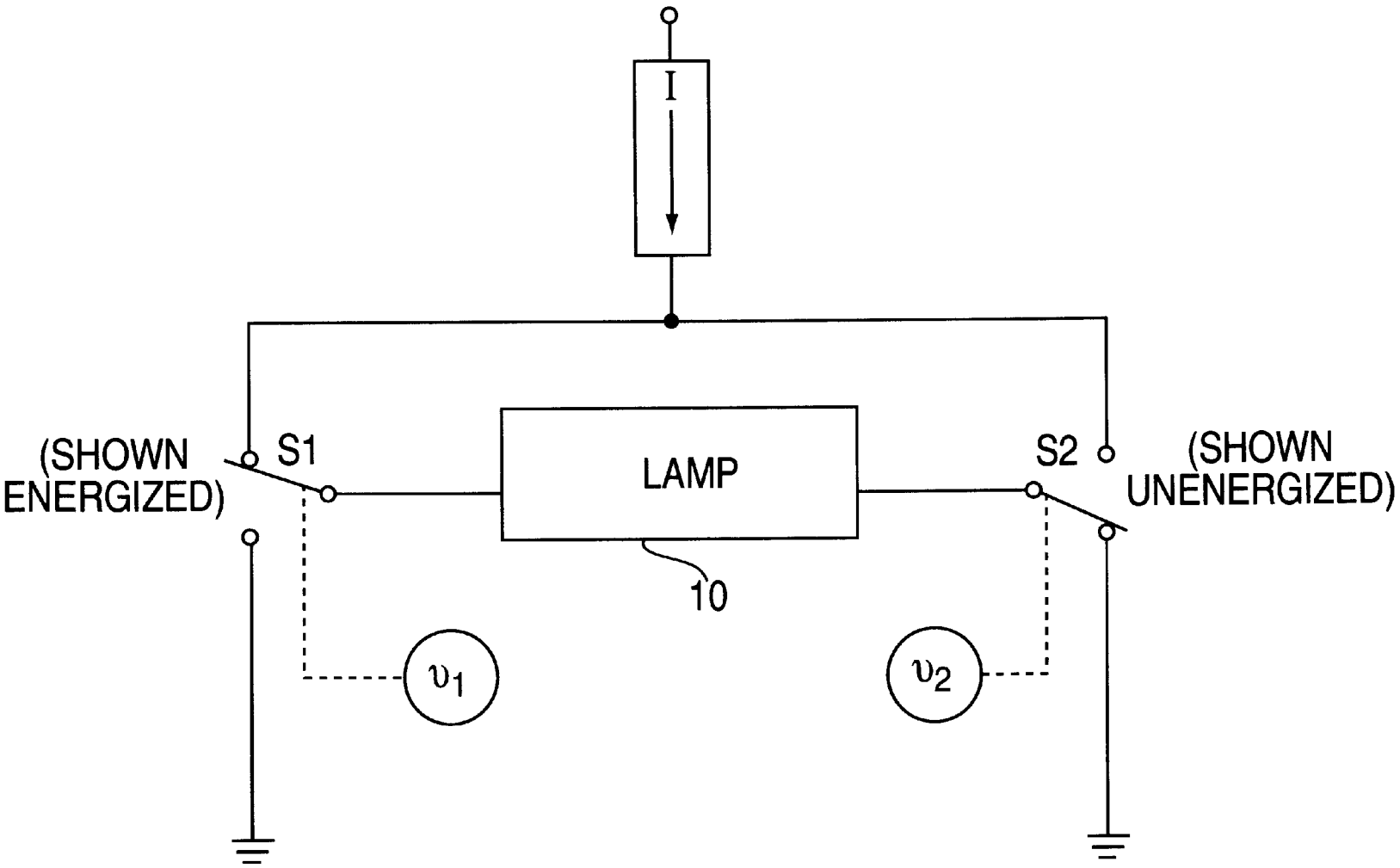
FIG. 8 is a schematic diagram of a configuration of the current-based low brightness supply of FIG. 4.
Figure 9:
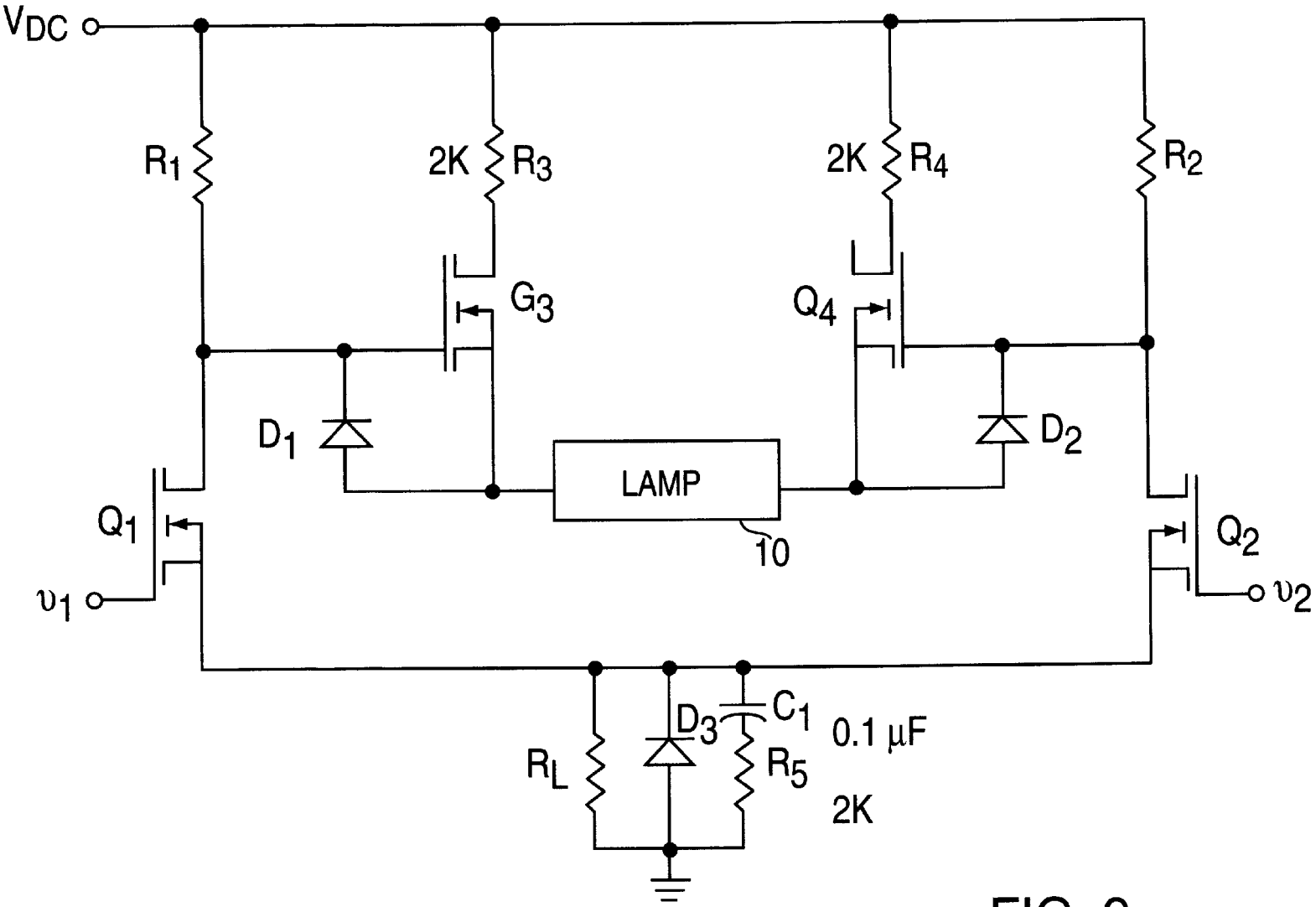
FIG. 9 is a schematic diagram of an implementation of the current-based low brightness supply of FIG. 8.
Figure 9:
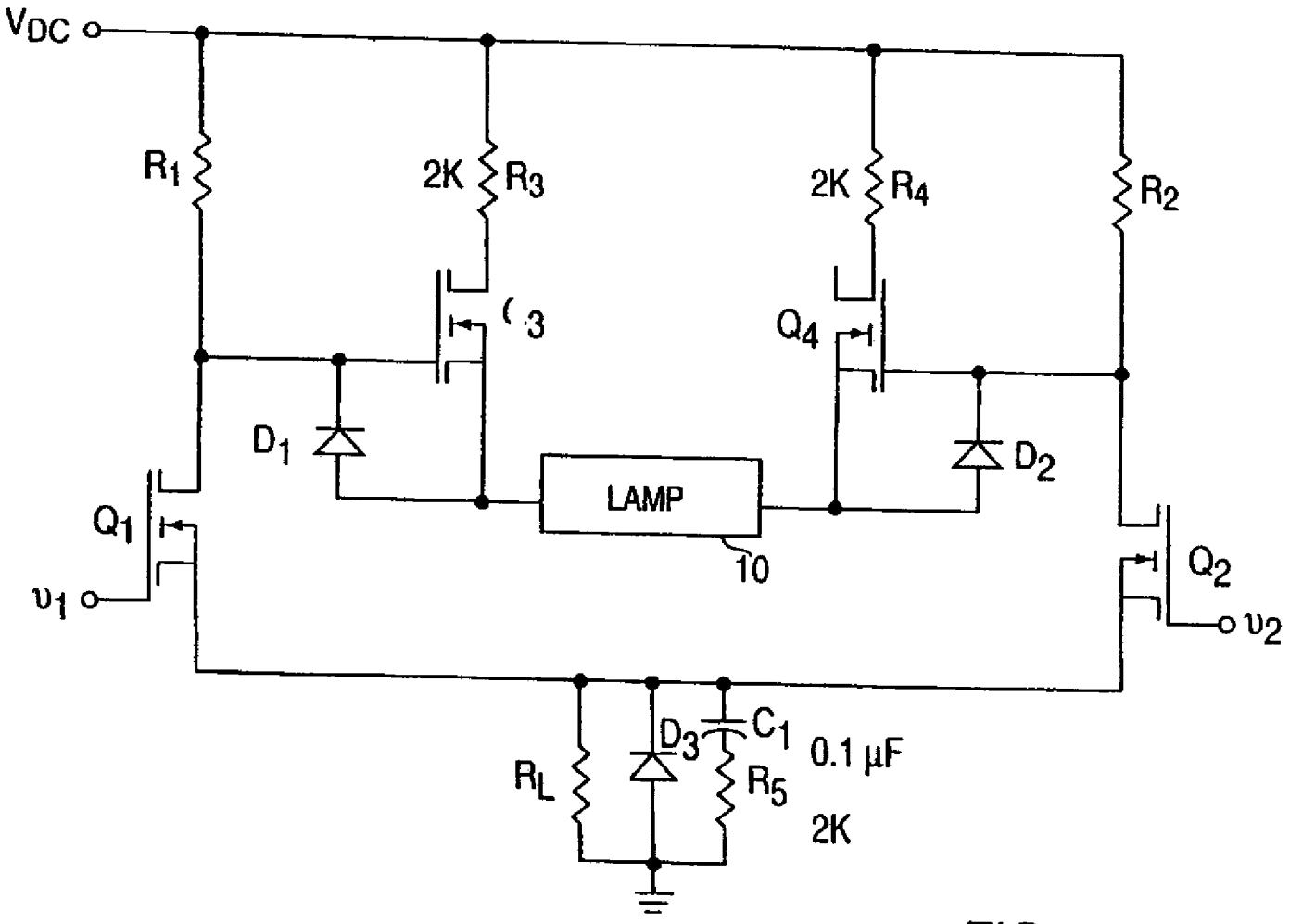

A configuration for the current-based low brightness supply of FIG. 4 is shown in FIG. 8. The lamp 10 is driven by a constant current source I in alternating opposite directions by switches SI and S2 controlled by voltage generators $v_1$ and $v_2$, respectively. An implementation of the circuit of FIG. 8 is shown in FIG. 9. The lamp 10 is flanked on each side by a buffer ($Q_1$ and $R_1$, or $Q_2$ and $R_2$) and a source-follower ($Q_1$ and $R_3$, or $Q_4$ and $R_4$). The buffers are driven by the voltage generators $v_1$ and $v_2$. The current through the lamp 10 is determined by the gate voltage of either $Q_1$ or $Q_2$, less the gate-to-source drop, divided by the value of the load resistor $R_L$. Assuming a gate input voltage of 12 volts and a gate-to-source drop of 3 volts, and value of 2.4 K for the load resistor $R_L$, the current will then be 3.75 ma.

The diodes $D_1$ and $D_2$ protect the gate-source junctions of $Q_3$ and $Q_4$ by preventing the voltage across those junctions from reaching an excessive level whenever the transistors are switched.

Similar to the diode in FIG. 7, diode $D_3$ prevents $Q_1$ and $Q_2$ from turning on as a result of the source voltage going to less than zero when the drive is zero. The series combination of $C_1$ and $R_5$ has a short time constant and provides a charging circuit for the parasitic capacitances of the transistors $Q_1$ and $Q_2$. The arrangement in FIG. 9 dissipates less power than the voltage-based circuits because the circuit uses current control to vary the brightness of the lamp 10, instead of large voltage drops across load resistors.

In operation, the circuit of FIG. 1 can provide variable light output over a broad range. At the high end of brightness, the high brightness supply 30 can be configured to provide sufficient energy to the lamp 10 to produce a variable light intensity from a maximum value, determined by the characteristics of the lamp 10 and voltage applied to the lamp 10, down to some minimum value. The lamp in this circumstance operates mostly in the arc discharge mode or region, and perhaps partially in the glow discharge region. After a transition, e.g., by switching the relay K1, the low brightness supply 40 provides energy to the lamp 10, maintaining the voltage on the lamp 10 to a level that keeps the operation of the lamp 10 in the glow discharge mode or region. When powered by the low brightness supply 40, the lamp's output is more uniform at very low luminance levels.

If desired, the components, voltages, duty cycles, and other parameters can be chosen to provide an overlap between the high and low brightness ranges. A slight overlap between the high and low ranges will avoid any discontinuity in brightness.

What is claimed is:

1. A fluorescent lamp system comprising:

a fluorescent lamp;

first means for providing electrical energy to the lamp to continuously maintain operation of the lamp in a glow discharge mode in a first range of brightness;

second means for providing electrical energy to the lamp to continuously maintain operation of the lamp in a glow discharge mode in a second range of brightness; and means for switching from the first means for providing electrical energy to the lamp to the second means for providing electrical energy to the lamp to dim the brightness of the lamp.

2. A system as set forth in claim 1, where the second means for providing electrical energy comprises a source of pulse-width modulated bipolar voltage or current of a level sufficient to maintain the operation of the lamp in the glow discharge mode.

3. A system as set forth in claim 2 where the bipolar voltage or current is a low frequency square wave signal.

4. A system as set forth in claim 1, where the first and second ranges of brightness overlap.

5. A dimming control power supply system for a fluorescent lamp, said system comprising:

a first power supply for providing electrical energy to the lamp to continuously maintain operation of the lamp in a first range of brightness, said first power supply comprising a source of high frequency voltage or current;

a second power supply for providing electrical energy to continuously maintain operation of the lamp in a second range of brightness, said second power supply comprising a source of low frequency voltage or current of a level sufficient to continuously maintain operation of the lamp in a glow discharge mode; and a switch for switching between the first and second power supplies to cause dimming of the light of the lamp when said second power supply is connected to the lamp.

6. A system as set forth in claim 5, where the low-frequency voltage has a pulse-width modulated waveform.

7. A system as set forth in claim 6, where the intensity of the first range of brightness depends on the pulse width and RMS voltage of the pulse-width modulated waveform applied to the lamp.

8. A system as set forth in claim 5, further comprising two switches alternately connecting the second power supply to a first input and a second input of the lamp.

9. A system as set forth in claim 8, further comprising two generators each respectively controlling one of the two switches.

10. A system as set forth in claim 9, where the two generators produce complementary pulse-width modulated signals for producing the low-frequency voltage of a level sufficient to continuously maintain the operation of the lamp in the glow discharge mode.

11. A system as set forth in claim 10, where the duty cycles of the modulated signals are varied to alter the brightness of the lamp within the first range of brightness.

12. A system as set forth in claim 5, where the low-frequency voltage has a frequency in the range of 60–400 Hz.

13. A dimming control system for operating a fluorescent lamp in either a high or a low brightness range and comprising a first power source for causing a continuous glow discharge within the fluorescent lamp to produce the high brightness range, a second power source at below the ignition level of the fluorescent lamp for operating the fluorescent lamp continuously in the glow discharge mode in the low brightness range, and switch means for connecting either said first or said second power source to the fluorescent lamp, said second power source comprising one or more power generators for producing pulse modulated wave pulses of duty cycles less than 100% and in a frequency range of from 60–400 hz.

14. The system in accordance with claim 13 wherein said second power source produces pulses at approximately 100 hz.

15. The system of claim 13 wherein said second power source comprises a source of supply voltage, first and second transistors connecting opposite terminals of the fluorescent lamp to one side of the supply voltage, and means for applying signals to said transistors at a duty cycle to achieve desired lower brightness level.

16. The system in accordance with claim 13 wherein said second power source comprises a constant current source, a first pair of a series connected resistor and transistor connecting said constant current source to opposite sides of the fluorescent lamp, a second pair of series connected resistor and transistor, each of said transistor of said first pair being connected to the connection between the resistor and transistor of one said second pair, and means for applying voltage signals to said transistors of said second pair to provide the appropriate duty cycle for the low level of brightness desired.

* * * * *

UNITED STATES PATENT AND TRADEMARK OFFICE

CERTIFICATE OF CORRECTION

PATENT NO. : 6,097,162
APPLICATION NO. : 09/135185
DATED : August 1, 2000
INVENTOR(S) : Ronald F. Welch et al.

It is certified that error appears in the above-identified patent and that said Letters Patent is hereby corrected as shown below:

Delete the old existing drawing of fig 9 and insert the new fig 9 drawing that is illustrated on the attached page.

In column 2, line 51, replace “Q1” with -- Q3 --.

In claim 1, column 3, line 29 and in claim 13, column 4, line 27, replace “glow” with -- arc --.

Signed and Sealed this

Nineteenth Day of May, 2009

John Doll

JOHN DOLL
*Acting Director of the United States Patent and Trademark Office*